US009228457B2

(12) United States Patent
Okazoe

(10) Patent No.: US 9,228,457 B2
(45) Date of Patent: Jan. 5, 2016

(54) VALVE TIMING ADJUSTING DEVICE, APPARATUS FOR MANUFACTURING SAME AND METHOD FOR MANUFACTURING SAME

(71) Applicant: DENSO CORPORATION, Kariya, Aichi-pref. (JP)

(72) Inventor: Kaoru Okazoe, Anjo (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/201,264

(22) Filed: Mar. 7, 2014

(65) Prior Publication Data

US 2014/0290605 A1 Oct. 2, 2014

(30) Foreign Application Priority Data

Mar. 29, 2013 (JP) ..... 2013-072266

(51) Int. Cl.
*F01L 1/34* (2006.01)
*F01L 1/344* (2006.01)

(52) U.S. Cl.
CPC ..... *F01L 1/3442* (2013.01)

(58) Field of Classification Search
CPC ..... F01L 1/3442; F01L 1/344; B23P 11/00
USPC ..... 123/90.15, 90.17
See application file for complete search history.

(56) References Cited

U.S. PATENT DOCUMENTS

2001/0047781 A1 12/2001 Fukuhara et al.
2010/0192883 A1* 8/2010 Tomimatsu et al. ..... 123/90.15
2012/0285407 A1 11/2012 Watanabe
2013/0228142 A1 9/2013 Kobayashi et al.

FOREIGN PATENT DOCUMENTS

JP A-9-209722 8/1997
JP H10-159520 A 6/1998
JP 2011-058365 A 3/2011
JP 2012-237196 A 12/2012
JP 2013-209976 A 10/2013
WO 01/34947 A1 5/2001

OTHER PUBLICATIONS

Apr. 2, 2015 Notification of Reasons for Refusal issued in Japanese Application No, 2013-072266.

* cited by examiner

*Primary Examiner* — Zelalem Eshete
(74) *Attorney, Agent, or Firm* — Oliff PLC

(57) ABSTRACT

A valve timing adjusting device for and engine includes a sprocket configured to rotate by receiving drive power from a driving shaft, a vane rotor fixed to a driven shaft so as to be rotatable relative to the sprocket, a housing that includes an oil chamber housing the vane rotor and is fixed to one end in a thickness direction of the sprocket, a bolt fixing the sprocket to the housing, and a knock pin inserted into a sprocket hole formed in the sprocket at one end thereof and into a housing hole formed in the housing at the other end thereof to restrict relative relation between the sprocket and the housing. The knock pin abuts against an inner wall of the sprocket hole at one end thereof, and abuts against an inner wall of the housing hole at the other end thereof.

8 Claims, 9 Drawing Sheets

VALVE TIMING ADJUSTING DEVICE, APPARATUS FOR MANUFACTURING SAME AND METHOD FOR MANUFACTURING SAME

This application claims priority to Japanese Patent Application No. 2013-72266 filed on Mar. 29, 2013, the entire contents of which are hereby incorporated by reference.

BACKGROUND OF THE INVENTION

1. Field of the Invention

The present invention relates to a valve timing adjusting device for adjusting open/close timing of an intake valve or an exhaust valve of an engine, a manufacturing apparatus for manufacturing the valve timing adjusting device and a method for manufacturing the valve timing adjusting device.

2. Description of Related Art

There are known valve timing adjusting devices configured to adjust open/close timing of an intake valve or an exhaust valve of a vehicle engine by varying the rotational phase between the crankshaft (driving shaft) and the camshaft (driven shaft) of a vehicle engine.

For example, Japanese Patent Application Laid-open No. H9-209722 describes a valve timing adjusting device which includes a sprocket receiving torque from a crankshaft, a vane rotor fixed to the camshaft, a housing with an oil chamber housing the vane rotor, and a sleeve disposed rotatably relative to the camshaft. A knock pin is inserted into a hole formed in the sleeve, a hole formed in the sprocket and a hole formed in the housing. The sprocket, the housing and the sleeve are fastened to one another by this knock pin and a bolt so that they can rotate together.

However, there is a slight clearance between the inner wall of the hole of the sprocket and the knock pin depending on tolerance of the inner diameter of the hole of the sprocket and the outer diameter of the knock pin. Further, there is a slight clearance between the inner wall of the hole of the housing and the knock pin depending on tolerance of the inner diameter of the housing of housing and the outer diameter of the knock pin. Incidentally, the vane rotor of the valve timing adjusting device may be at the intermediate phase position while the engine is stopped. In addition, generally, the oil in the oil chamber of the valve timing adjusting device is evacuated therefrom while the engine is stopped. Accordingly, since the oil flows into the oil chamber rapidly when the vane rotor is phase-controlled to its starting position at the time of engine start, there is a concern that the vane rotor may collide with the inner wall of the oil chamber, causing positional deviation between the housing and the sprocket If the positional deviation causes the bolt fixing the sprocket, housing and the sleeve to be loosened relative to each other, it may be difficult for the valve timing adjusting device to control the phase between the crankshaft and the camshaft.

SUMMARY

According to an exemplary embodiment, there is provided a valve timing adjusting device for adjusting open/close timing of an intake valve or an exhaust valve driven by a driven shaft of an engine by varying a rotational phase between the driven shaft and a driving shaft of the engine, including:

a sprocket configured to rotate by receiving drive power from the driving shaft;

a vane rotor fixed to the driven shaft so as to be rotatable relative to the sprocket;

a housing that includes an oil chamber housing the vane rotor, the housing being fixed to one end in a thickness direction of the sprocket;

a bolt fixing the sprocket to the housing; and a knock pin inserted into a sprocket hole formed in the sprocket at one end thereof and into a housing hole formed in the housing at the other end thereof to restrict relative relation between the sprocket and the housing;

wherein, when a direction to which the vane rotor is phase-controlled at the time starting the engine is referred to as a first direction, and a direction opposite to the first direction is referred to as a second direction, the knock pin abuts against an inner wall in the first direction of the sprocket hole at one end thereof, and abuts against an inner wall in the second direction of the housing hole at the other end thereof.

According to an exemplary embodiment, there is provided also a manufacturing apparatus for manufacturing the valve timing apparatus recited above, including:

a lower jig for rotatably supporting the sprocket in a state where one end of the knock pin is inserted into the sprocket hole of the sprocket;

an upper jig rotatably supporting the housing in a state where the other end of the knock pin is inserted into the housing hole of the housing;

a first pusher for rotating the housing to the first direction to which the vane rotor is rotated relative to the housing at the time of starting the engine; and a second pusher for rotating the sprocket to the second direction opposite to the first direction.

According to an exemplary embodiment, there is provided also a manufacturing method of manufacturing the valve timing adjusting device recited above using the manufacturing apparatus recited above, including:

a preparation step of housing the vane rotor between the housing and the sprocket, inserting one end of the knock pin into the sprocket hole and inserting the other end of the knock pion into the housing hole;

a first clamping step of pressing the housing and the sprocket toward each other at a load under which the sprocket placed on the lower jig and the housing placed on the upper jig can rotate relative to each other;

a first rotating step of rotating the housing to the first direction to which the vane rotor is rotated relative to the housing at the time of starting the engine;

a second rotating step of rotating the sprocket to the second direction opposite to the first direction;

a second clamping step of pressing the lower jig and the upper jig toward each other at a load under which the housing and the sprocket cannot rotate relative to each other; and a coupling step of coupling the sprocket and the housing to each other by the bolt.

According to the exemplary embodiment, there is provide a valve timing adjusting device capable of correctly performing phase control between a driving shaft and a driven shaft of an engine to thereby correctly adjust open/close timing of an intake valve or an exhaust valve of the engine.

Other advantages and features of the invention will become apparent from the following description including the drawings and claims.

PREFERRED EMBODIMENTS OF THE INVENTION

First Embodiment

Figure 1:
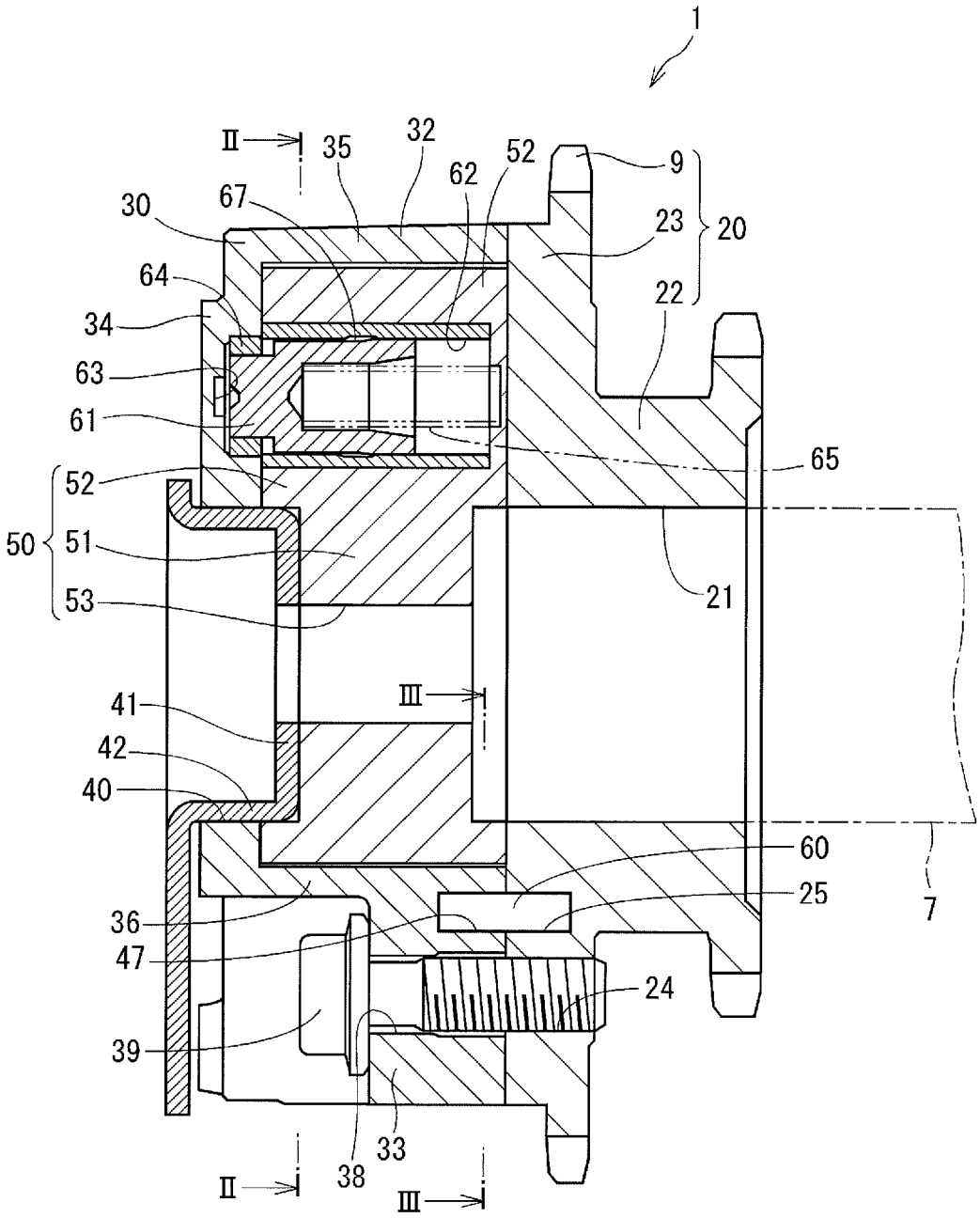
FIG. 1 is a cross-sectional view of a valve timing adjusting device according to a first embodiment of the invention.

A valve timing adjusting device 1 according to a first embodiment of the invention is described with reference to FIGS. 1 to 7 and 8A to 8C. As shown in FIG. 4, the valve timing adjusting device 1 is used in a drive power transmission mechanism for an engine 2. This drive power transmission mechanism includes a gear 4 fixed to a crankshaft 3 as a driving shaft of the engine 2, gears 8 and 9 fixed to camshafts 6 and 7 as driven shafts, and a chain 10 wound around the gears 4, 8 and 9. The torque of the crankshaft 3 is transmitted to the camshafts 6 and 7. The camshaft 6 drives an exhaust valve 11. The camshaft 7 drives an intake valve 12. The valve timing adjusting device 1 adjusts the open/close timing of the intake valve 12 by causing the crankshaft 3 and the camshaft 7 connected with a vane rotor 50 (see FIG. 1) to rotate in the clockwise direction in FIG. 4 with a predetermined phase difference therebetween.

Figure 2:
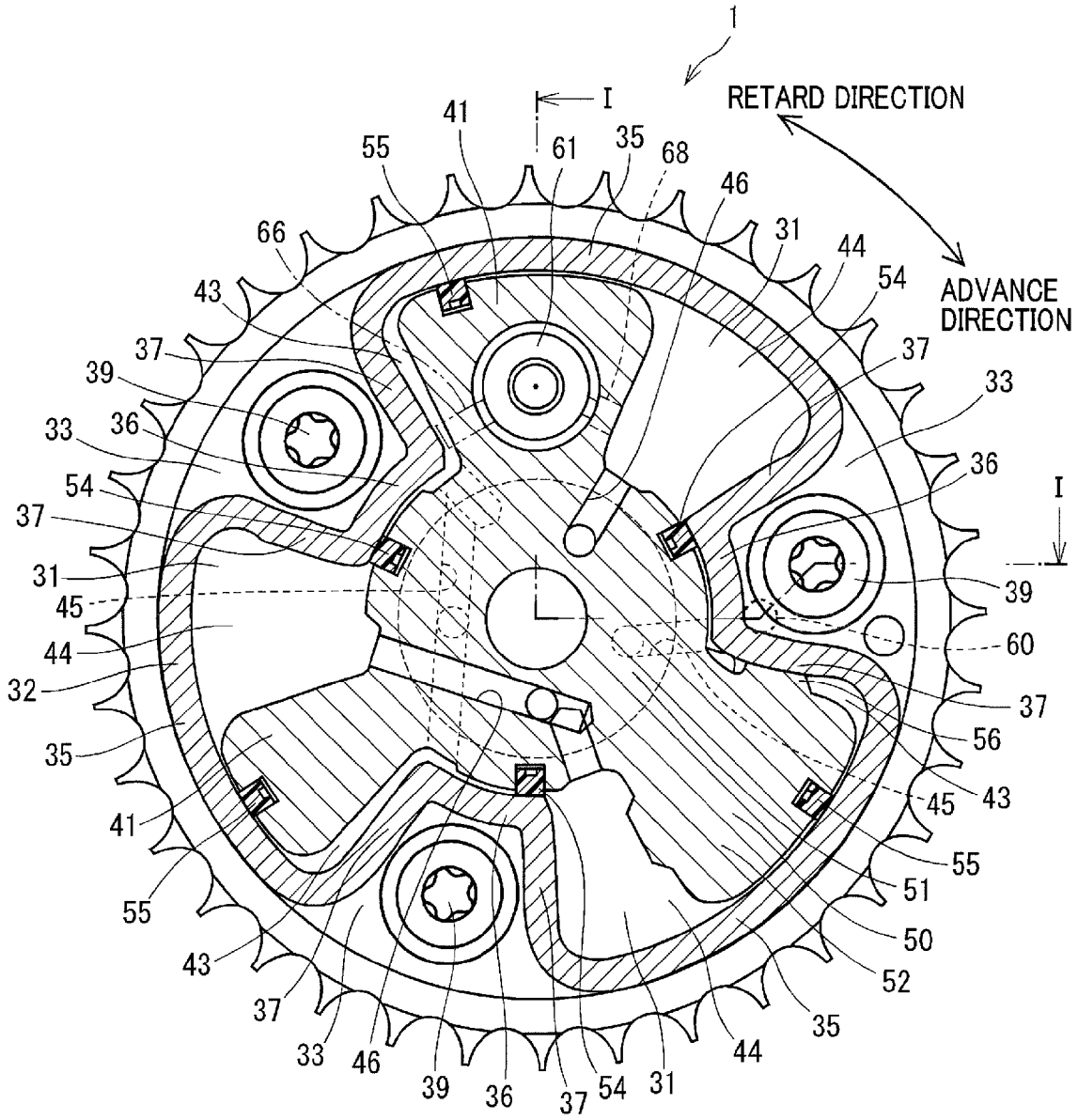
FIG. 2 is a cross-sectional view taken along line II-II in FIG. 1.

As shown in FIGS. 1 and 2, the valve timing adjusting device 1 includes a sprocket 20, a housing 30, the vane rotor 50 and a knock pin 60. The sprocket 20 includes a barrel portion 22 formed with a hole 21 through which the camshaft 7 can pass, a disk portion 23 radially extending from one end of the barrel portion 22 and the gear 9 located at the outer circumference of the disk portion 23. The chain 10 wound around the gear 9 transmits the torque of the crankshaft 3 to the sprocket 2 to rotate the sprocket 2.

The housing 30 is fixed to one end in the thickness direction of the disk portion 23 of the sprocket 20. The housing 30 includes a circumferential wall 32 forming a plurality of oil chambers 31 each having a fan-like cross section, a plurality of attaching portions 33 located outside the plurality of the oil chambers 31 and a front plate 34 located at the side opposite to the sprocket 20 of the circumferential wall 32. The circumferential wall 32 is constituted of outer arc portions 35 located radially outward of the vanes 52 of the vane rotor 50 housed in the oil chambers 31, inner arc portions 36 located radially outward of the rotor 51 of the vane rotor 50 and partitioning portions 37 connecting the outer arc portions 35 to the inner arc portions 36.

The attach portions 33 are provided so as to connect the adjacent partitioning portions 37. Each attaching portion 33 has a bolt hole 38 extending in the thickness direction thereof. The sprocket 20 is formed with female threads 24 at positions corresponding to the bolt holes 38 of the attaching portions 33. Bolts 39 are inserted into the bolt holes 38 of the attaching portions 33 and screwed to the female threads 24 of the sprocket 20 to fix the housing 30 to the sprocket 20. The front plate 34 provided at the side opposite the sprocket 20 of the circumferential wall 32 is formed with a circular hole 40 at its center. A cover 41 is provided to close the circular hole 40. The cover 41 includes a cylindrical concave portion 42 inserted into the circular hole 40.

The vane rotor 50 including the cylindrical rotor 51 and the vanes 52 extending radially outward from the rotor 51 is housed between the sprocket 20 and the housing 30. The vane rotor 50 can rotate relative to the sprocket 20 and the housing 30. The vane rotor 50 has a center hole 53. The vane rotor 50 is fixed to an end portion of the camshaft 7 unrotatably relative to each other by a center bolt (not shown) fitted to the center hole 53.

The rotor 51 is disposed radially inward of the inner arc portions 36 of the housing 30. Seal members 54 are provided in the radially outer wall of the rotor 51. Each seal member 54 slidably and liquid-tightly contacts with the inner wall of the corresponding inner arc portion 36 of the housing 30 to restrict oil flow between the adjacent oil chambers 31. Each vane 52 is located inward of the corresponding outer arc portion 35 and partitioning portion 35 of the housing 30 so as to partition the oil chamber 31 into an advance chamber 43 and a retard chamber 44. A seal member 55 is provided in the radially outer wall of each vane 52. Each seal member 55 slidably and liquid-tightly contacts with the inner wall of the outer arc portion 35 of the housing 30 to restrict oil flow between the advance chamber 43 and the retard chamber 44.

The vane rotor 50 is formed with a plurality of advance oil passages 45 leading to the advance chamber 43, and a plurality of retard oil passages 46 leading to the retard chamber 44. These advance and retard oil passages are in communication with a not-shown oil passage formed in the camshaft 7. The oil drawn from a not-shown oil pan of a vehicle by an oil pump flows from a not-shown oil pressure control valve to the advance and retard oil passages 45 and 46 through the oil passage of the camshaft 7. When the oil is supplied from the advance oil passages 45 to the advance oil chambers 43, the oil in the retard oil chambers 44 is evacuated from the retard oil passages 46. As a result, the vane rotor 50 moves in the advance direction relative to the housing 30. On the other hand, when the oil is supplied from the retard oil passages 46 to the retard oil chambers 44, the oil in the advance oil chambers 43 is evacuated from the advance oil passages 45. As a result, the vane rotor 30 moves in the retard direction relative to the housing 30.

The two-way arrow in FIG. 2 shows the advance direction and the retard direction of the vane rotor 50 relative to the housing 30. The advance direction coincides with the rotating direction of the camshaft 7, and the retard direction is opposite to the rotating direction of the camshaft 7. FIG. 2 shows a state where the vane rotor 50 is phase-controlled to the most retarded position relative to the housing 30. In this state, an abutment portion 56 formed in the outer wall on the retard side of the vane 52 of the vane rotor 50 abuts against the inner wall of the corresponding partitioning portion 37 of the housing 30.

As shown in FIGS. 1 and 2, the knock pin 60, which is formed in a column shape, is inserted into a sprocket hole 25 formed in the sprocket 20 at one end thereof and pressure-inserted into a housing hole formed in the housing 30 at the other end thereof. The knock pin 60 restricts relative rotation between the sprocket 20 and the housing 30. The housing hole 47 is provided in the attaching portion 33 which adjoins to the partitioning portion 37 of the housing 30 against which the abutment portion 56 of the vane rotor 50 can abut. The housing hole 47 is a blind hole which is opened at the side of the sprocket 20, and is closed at the side opposite to the sprocket 20. The sprocket hole 25 is provided in the sprocket 20 at a position corresponding to the housing hole 47. The sprocket hole 25 is a blind hole which is opened at the side of the housing 30, and is closed at the side opposite to the housing 30.

Figure 3:
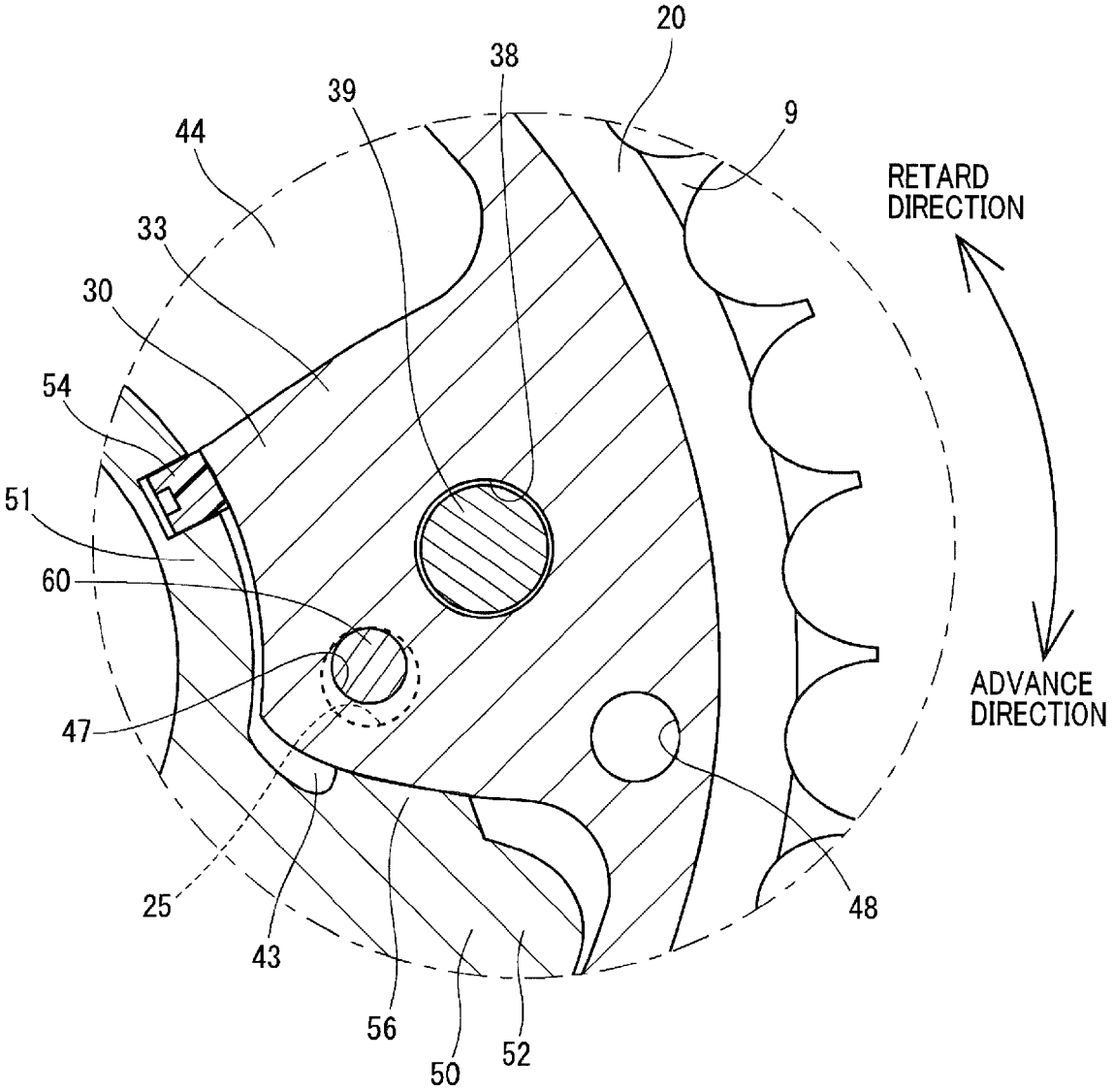
FIG. 3 is a cross-sectional view taken along line in FIG. 1.
Figure 4:
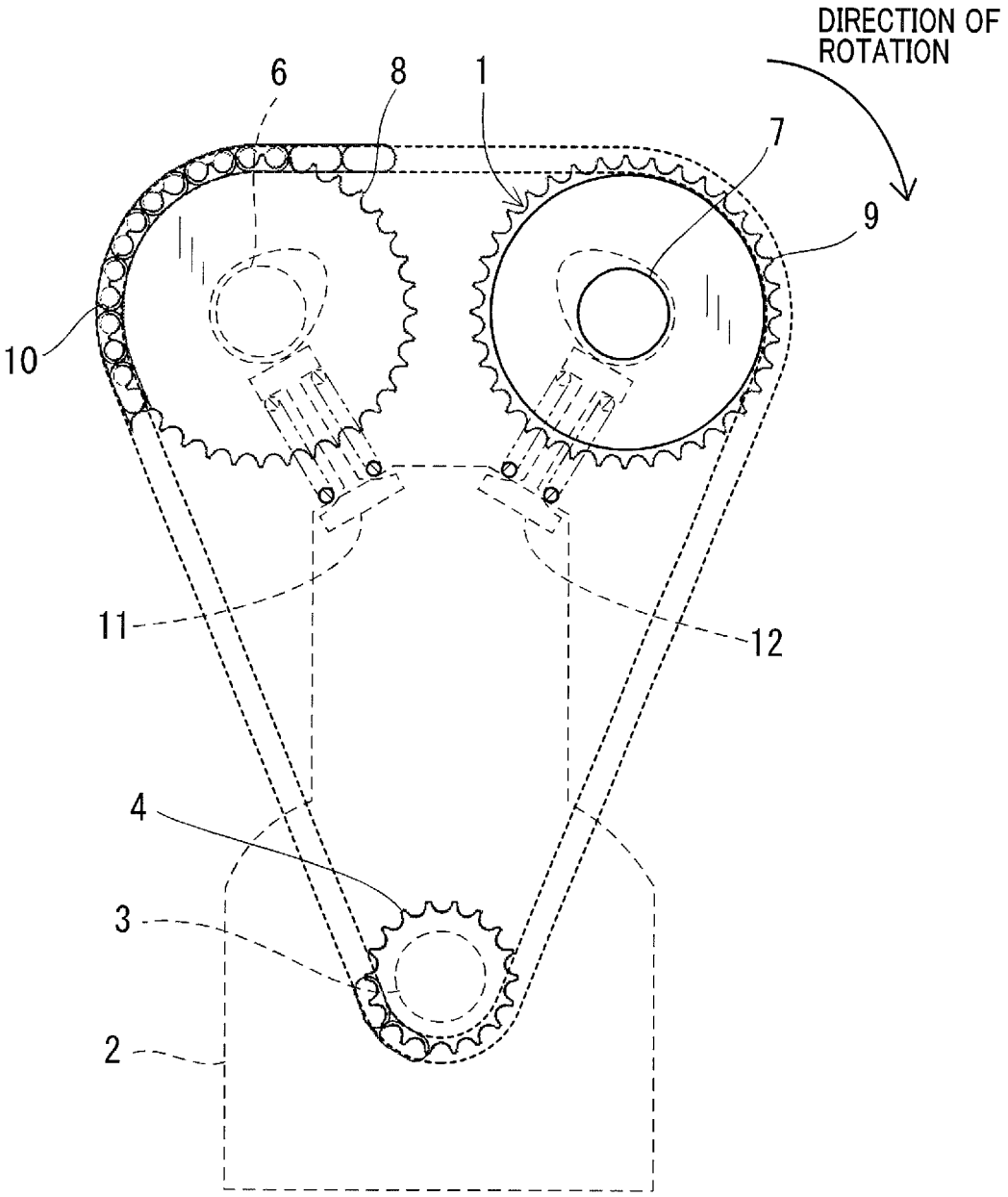
FIG. 4 is a diagram showing a drive power transmission mechanism including the valve timing adjusting device according to the first embodiment of the invention.
Figure 5:
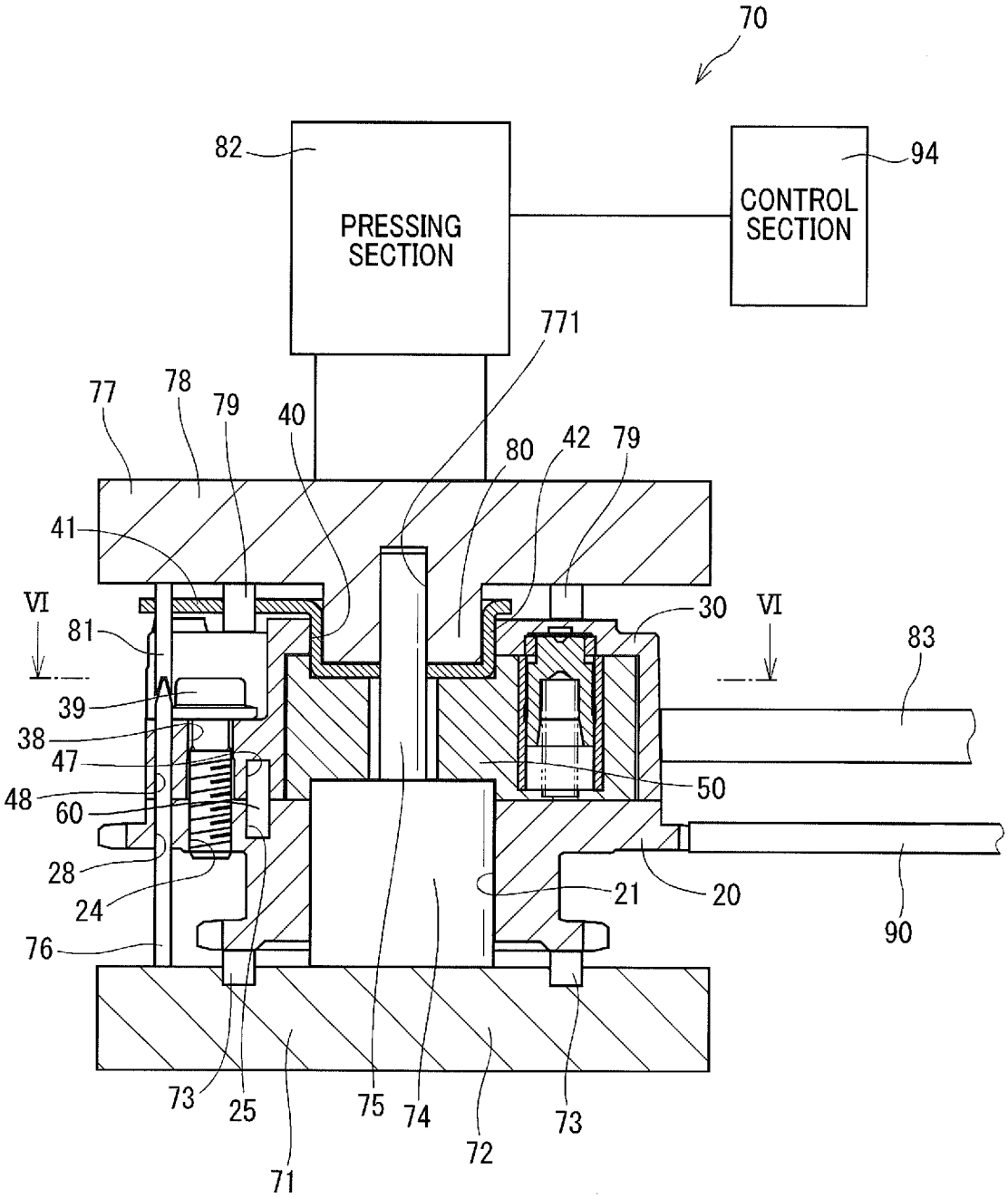
FIG. 5 is a diagram schematically showing an apparatus for manufacturing the valve timing adjusting device according to the first embodiment of the invention.

As shown in FIG. 3, the knock pin 60 abuts against the inner wall of on the retard side of the sprocket hole 25 at one end thereof, and is pressure-inserted into the housing hole 47 at the other end thereof. FIG. 3 is a cross-sectional view taken along line in FIG. 1. However, to ease explanation, the sprocket hole 25 is shown by a broken line, and the diameter of the sprocket hole 25 is shown larger than its actual size. When the vane rotor 50 is phase-controlled to the retard side, and its abutment portion 56 collides with the partitioning portion 37 and the attaching portion 33 of the housing 30, the collision force causes the housing 30 to rotate in the retard direction relative to the sprocket 20. At this time, the knock pin 60 can prevent positional deviation between the housing 30 and the vane rotor 50 due to the collision force.

As shown in FIGS. 1 and 2, a stopper pin 61 is housed axially movably in a housing hole 62 formed in the vane rotor 50. The front plate 34 is formed with a fitting hole 63 including a ring 64 to which the stopper pin 61 can fit. When the vane rotor 50 is at the most retarded position relative to the housing 30, the stopper pin 61 can fit to the ring 64 provided in the fitting hole 63 by being biased by a spring 65. While the stopper pin 61 fits to the ring 64, the vane rotor 50 and the housing 30 are restricted from rotating relative to each other.

The fitting hole 63 of the front plate 34 is in communication with one of the advance chamber 43 and the retard chamber 44 through an oil passage 66. A pressure chamber 67 is formed radially outward of the stopper pin 61. The pressure chamber 67 is in communication of one of the advance chamber 43 and the retard chamber 44 through an oil passage 68. Both the oil pressure of the fitting hole 63 and the oil pressure of the pressure chamber 67 act to extract the stopper pin 61 from the ring 64. Accordingly, if the sum of the force applied to the stopper pin 61 by the oil pressure of the fitting hole 63 and the force applied to the stopper pin 61 by the oil pressure of the pressure chamber 67 exceeds the biasing force of the spring 65, the stopper pin 61 is extracted from the ring 64.

Next, the operation of the valve timing adjusting device 1 having the structure described above is explained.

Engine Starting Period:

The vane rotor 50 is phase-controlled to the most retarded position shown in FIG. 2 at the time of starting the engine. The oil drawn from the oil pan of the vehicle by the oil pump is supplied to each retard chamber 44 through the retard oil passage 46. At this time, if the vane rotor 50 has been phase-controlled to the most retarded position before starting the engine, the stopper pin 61 enters inside the ring 64, and the position of the vane rotor 50 is kept unchanged. On the other hand, if the vane rotor 50 has not been phase-controlled to the most retarded position before starting the engine and is at an intermediate-phase position, the vane rotor 50 moves in the retard direction by the oil supplied to the retard chambers 44 when the engine is started, and its abutment portion 56 collides with the partitioning portion 37 and the attaching portion 33 of the housing 30. At this time, since the oil in the oil chamber 31 has been evacuated, the collision force at the moment when the abutment portion 56 of the vane rotor 50 collides with the partitioning portion 37 and the attaching portion 33 of the housing 30 is large.

Once the vane rotor 50 is phase-controlled to the most retarded position, the stopper pin 61 remains being inside the ring 64 until a sufficient amount of the oil is supplied to the fitting hole 63 or the pressure chamber 67. When the fitting hole 63 or the pressure chamber 67 has been supplied with the sufficient amount of the oil, the stopper pin 61 is extracted from the ring 64. As a result, the vane rotor 50 becomes able to rotate relative to the housing 30.

Advancing Period:

When the valve timing adjusting device 1 performs an advancing operation, the oil drawn by the oil pump is supplied to each advance chamber 43 through the advance oil passage 45. On the other hand, the oil in each retard chamber 44 is evacuated to the oil pan through the retard oil passage 46. As a result, the oil pressure of the advance chambers 43 acts on the vanes 52, and the vane rotor 50 moves to the advance side relative to the housing 30.

Retarding Period:

When the valve timing adjusting device 1 performs a retarding operation, the oil drawn by the oil pump is supplied to each retard chamber 44 through the retard oil passage 46. On the other hand, the oil in each advance chamber 43 is evacuated to the oil pan through the advance oil passage 45. As a result, the oil pressure of the retard chambers 44 acts on the vanes 52, and the vane rotor 50 moves to the retard side relative to the housing 30.

Next, a manufacturing apparatus 70 for manufacturing the valve timing adjusting device 1 described above is explained with reference to FIGS. 5 and 6. The manufacturing apparatus 70 includes a lower jig 71, an upper jig 77, a pressing section 82, a first pusher 83, a second pusher 90 and a control section 94.

The lower jig 71 includes a lower jig body 72, a sprocket receiver 73, a lower aligning member 74, a shaft member 75 and a lower positioning pin 76. The sprocket receiver 73 is fixed to the lower jig body 72, and is capable of pushing up the sprocket 20 toward the housing 30. The lower aligning member 74 is inserted into the hole 21 of the sprocket 20. The sprocket 20 can rotate around the lower aligning member 74. The shaft member 75, which extends from the lower aligning member 74 to the upper jig 77, passes through the center hole 53 of the vane rotor 50 and fits in the shaft hole of the upper jig 77. The lower positioning pin 76 is inserted into a positioning hole 28 formed in the sprocket 20 and a positioning hole 48 formed in the housing 30.

The upper jig 77 includes an upper jig body 78, a housing pressing portion 79, an upper aligning portion 80 and an upper positioning pin 81. The housing pressing portion 79 is fixed to the upper jig body 78, and is capable of pressing the housing 30 toward the sprocket 20. The upper aligning portion 80 is inserted into the cylindrical concave portion 42 of the cover 41 provided in the circular hole 40 of the housing 30. The housing 30 can rotate around the upper aligning portion 80. By fitting the shaft member 75 of the lower jig 71 into a shaft hole 771 formed in the upper jig 77, the center axis of the lower aligning portion 74 and the center axis of the upper aligning portion 80 coincide with each other. The upper positioning pin 81 fits to the lower positioning pin 76 extending from the lower jig body 72. As a result, the circumferential positions of the lower jig 71, the sprocket 20, the housing 30 and the upper jig 77 are fixed.

The pressing section 82, which may be a cylinder, is capable of pressing the upper jig 77 toward the lower jig 71.

The pressing force of the pressing section 82 can be adjusted to such an extent as to prevent the housing 30 and the sprocket 20 from rotating relative to each other. The pressing force of the pressing section 82 can be adjusted also to such an extent as to eliminate the clearance between the housing 30 and the sprocket 20.

Figure 6:
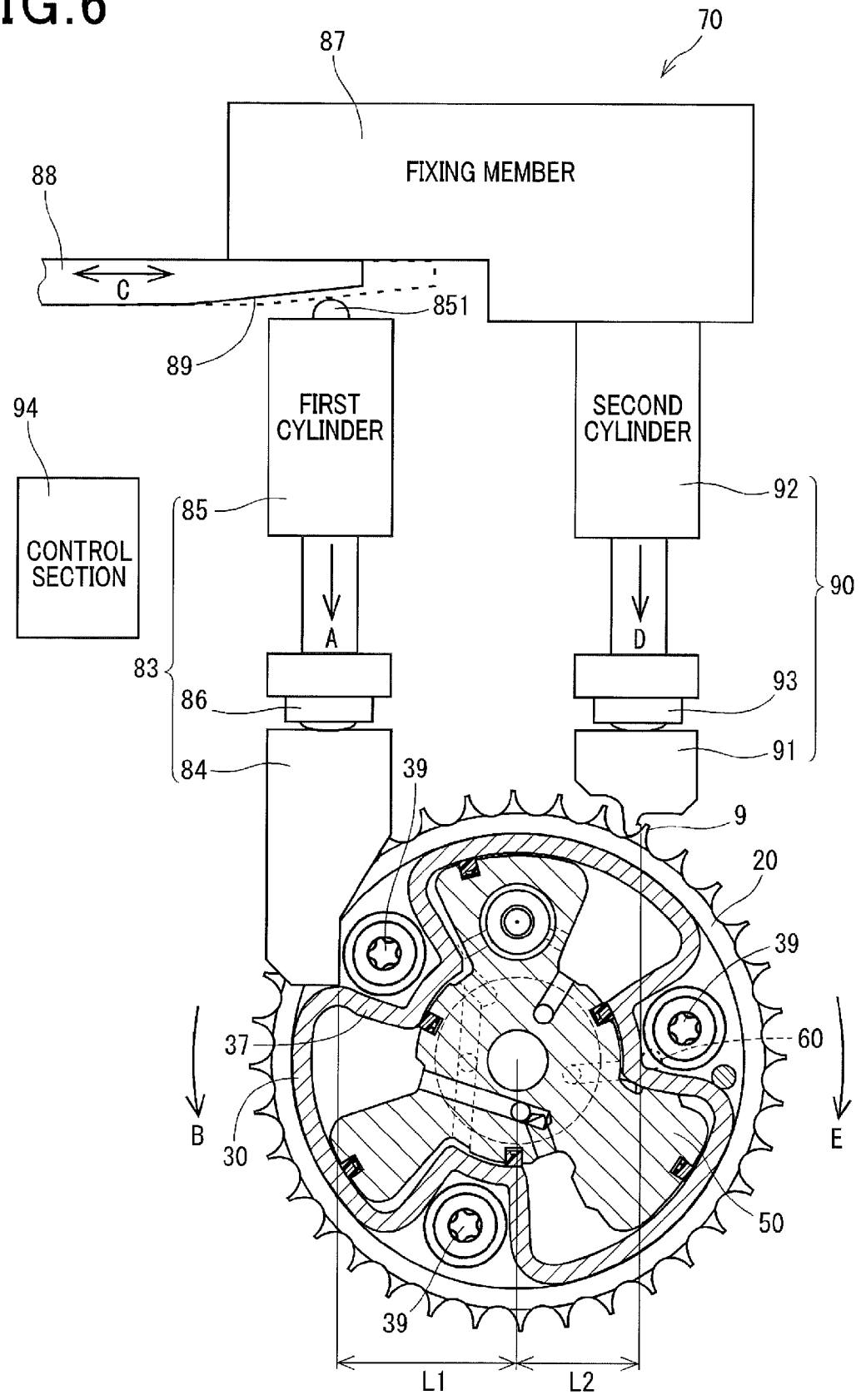
FIG. 6 is a cross-sectional view taken along line VI-VI in FIG. 5.
Figure 7:
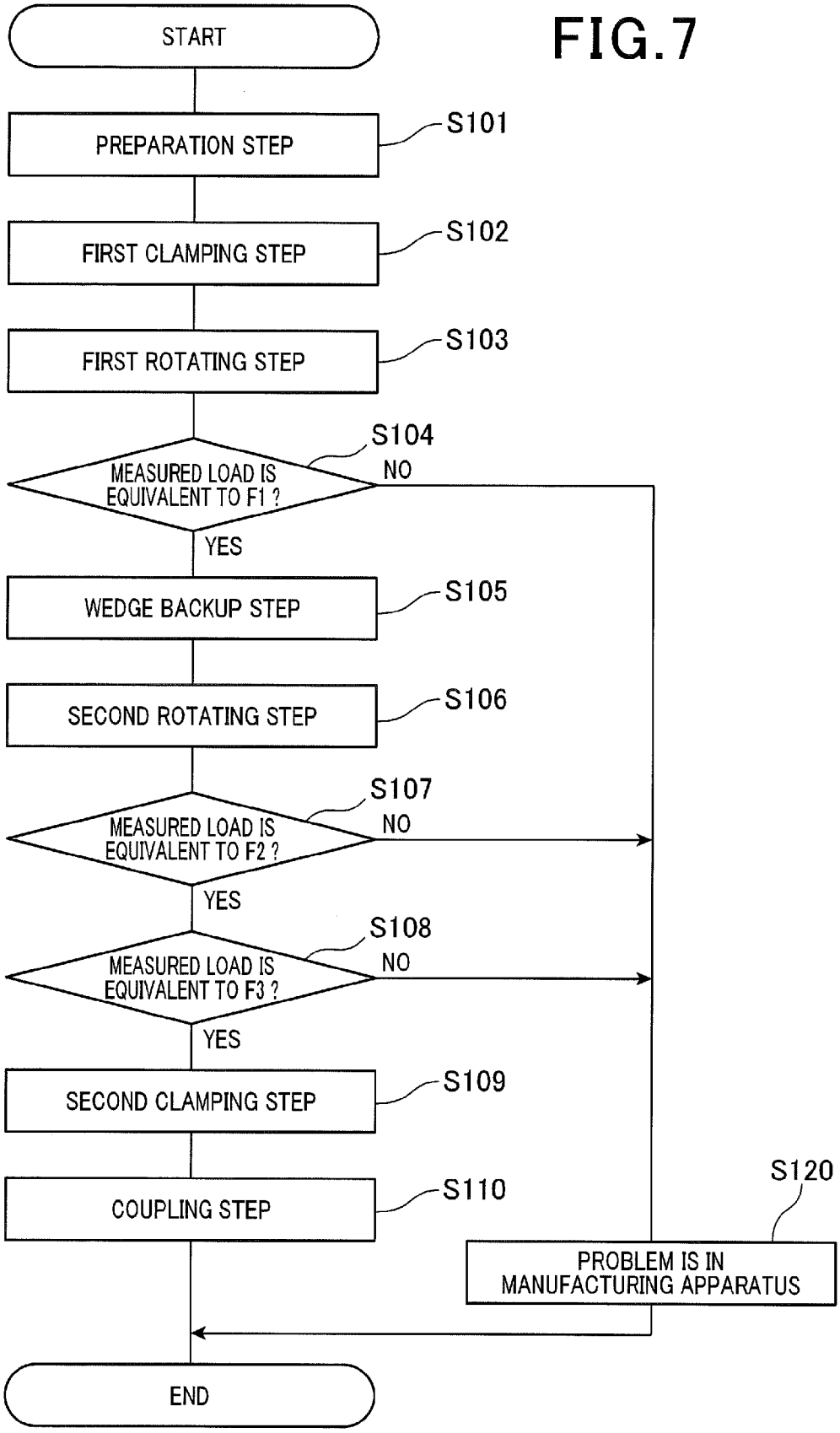
FIG. 7 is a flowchart showing steps of a method of manufacturing the valve timing adjusting device according to the first embodiment of the invention.

The first pusher 83 and the second pusher 90 are located in the radial direction of the housing 30 and the sprocket 20. The first pusher 83 includes a housing pressing portion 84, a first cylinder 85 and a first load cell 86. The housing pressing portion 84 abuts against the partitioning portion 37 of the housing 30. When the first cylinder 85 extends in the direction shown by the arrow A in FIG. 6, the housing pressing portion 84 linearly presses the partitioning portion 37 of the housing 30. As a result, the housing 30 rotates around the upper aligning portion 80 in the direction shown by the arrow B. In FIG. 6, the direction shown by the arrow B is the retard direction and the direction shown by the arrow E is the advance direction of the valve timing adjusting apparatus 1. The first load cell 86 measures the load applied between the housing pressing portion 84 and the first cylinder 85.

A fixing member 87 is provided at the side opposite to the housing 30 of the first pusher 83. The fixing member 87 is fixed to a not-shown installation stand together with the lower jig 77 or the upper jig 77. A wedge member 88 is disposed between an end portion 851 at the side opposite to the housing 30 of the first cylinder 85 and the fixing member 87. The wedge member 88 can move in the direction shown by the arrow C. The wedge member 88 includes an inclined surface 89 in which the thickness thereof increases in the direction from the distal end to the proximal end. When the wedge member 88 moves to the position shown by the broken line in FIG. 6, the inclined surface 89 of the wedge member 88 and the end portion 851 at the side opposite to the housing 30 of the first cylinder 85 abut against each other. The wedge member 88 is capable of restricting movement of the first pusher 83 toward the side opposite to the housing 30. The inclined surface 89 of the wedge member 88 makes it possible to absorb positional variation of the first cylinder 85 due to fabrication tolerance of the valve timing adjusting device 1.

The second pressure 90 includes a sprocket pressing portion 91, a second cylinder 92 and a second load cell 93. The sprocket pressing portion 91 abuts against the gear 9 of the sprocket 20. When the second cylinder 85 extends in the direction shown by the arrow D in FIG. 6, the sprocket pressing portion 91 linearly presses the gear 9 of the sprocket 20. As a result, the sprocket 20 rotates around the lower aligning portion 74 in the direction shown by the arrow E. The second load cell 93 measures the load applied between the sprocket pressing portion 91 and the second cylinder 92. The control section 94 including a computer controls driving of the respective components of the manufacturing apparatus 70. The values of the loads measured by the first and second load cells 86 and 93 are inputted to the control section 94.

Figure 8A:
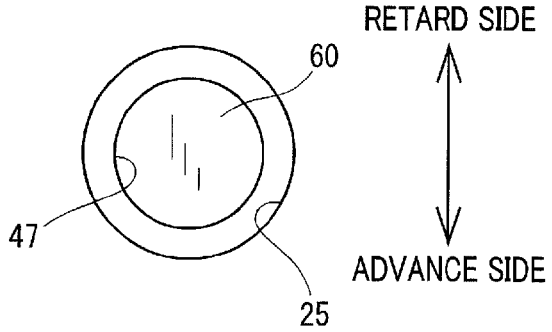
FIG. 8A is a diagram schematically showing a knock pin used in a preparation step included in the method shown in FIG. 7.

Next, a method of manufacturing the valve timing adjusting device 1 using the manufacturing apparatus 70 described above is explained with reference to FIGS. 7 and 8A to 8C. First, in a preparation step S101, the other end of the knock pin 60 is pressure-inserted into the housing hole 47, and then the one end of the knock pin 60 is inserted into the sprocket hole 25 while housing the vane rotor 50 between the housing 30 and the sprocket 20. At this time, as shown in FIG. 8A, there is a slight clearance between the knock pin 60 and the inner wall of the sprocket hole 25. Next, in a first clamping step S102, the sprocket 20 is placed on the lower jig 71, and the housing 30 is placed on the upper jig 77. Thereafter, the pressing section 82 is driven to press the sprocket 20 and the housing 30 at a load under which the sprocket 20 and the housing 30 can rotate relative to each other. For example, this load is 200 N. This pressing makes it possible to prevent a clearance being present between the housing 30 and the sprocket 20 in a first rotating step S103 and a second rotating step S106 that follow the first clamping step S102.

Figure 8B:
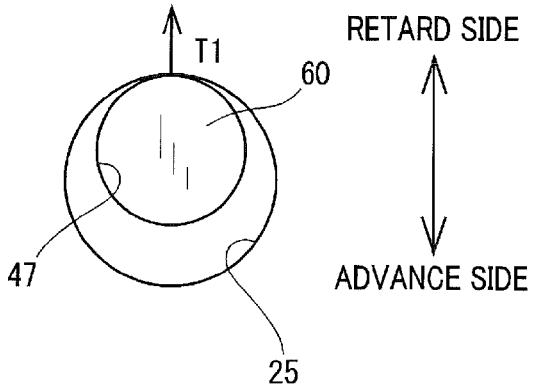
FIG. 8B is a diagram schematically showing the knock pin used in a first rotating step included in the method shown in FIG. 7.
Figure 8C:
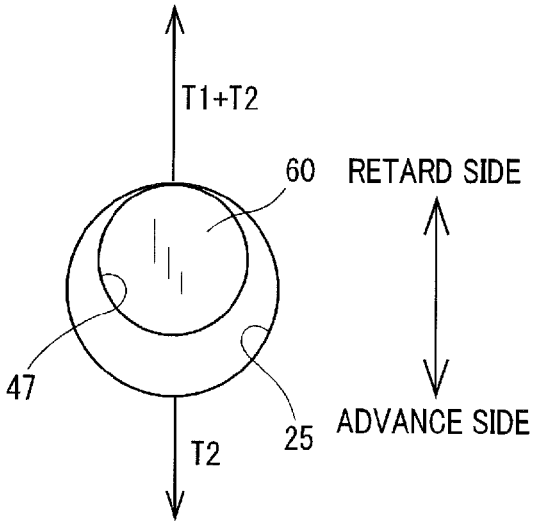
FIG. 8C is a diagram schematically showing the knock pin used in a second rotating step included in the method shown in FIG. 7.

In the first rotating step S103, the first cylinder 85 of the first pusher 83 is extended so that the housing pressing portion 84 presses the partitioning portion 37 of the housing 30. As a result, the housing 30 rotates in the retard direction. By performing the first rotating step S103, the knock pin 60 and the inner wall of the sprocket hole 25 abut against each other as shown in FIG. 8B. The knock pin 60 is applied with a torque T1 (Nm) outputted from the first cylinder 85. When the load outputted from the first cylinder 85 is F1 (N) and the distance between the rotation center of the housing 30 and the abutting position of the housing pressing portion 84 is L1 (m), the torque T1 (Nm) outputted from the first cylinder 85 is given by the following equation.

$$T1=F1\times L1 \quad \text{(Equation 1)}$$

However, there may be a case where the knock pin 60 and the inner wall of the sprocket hole 25 do not abut against each other, and the housing 30 does not rotate, if foreign matter is present between the upper aligning portion 80 of the upper jig 77 and the cylindrical concave portion 42 of the cover 41. This case will be explained later.

Subsequently, a first measuring step S104 is performed to measure the load applied between the housing pressing portion 84 and the first cylinder 85 using the first load cell 86. The control section 94 checks whether or not the load measured by the first load cell 86 is equivalent to the load F1 outputted from the first cylinder 85. If the check result is affirmative, the method proceeds to a wedge backup step S105. On the other hand, if the check result is negative, the method is terminated assuming that a problem has occurred in the manufacturing apparatus 70 (step S102).

In the wedge backup step S105, the wedge member 88 is moved to the position shown by the broken line in FIG. 6. As a result, the inclined surface 89 of the wedge member 88 and the end portion at the side opposite to the housing 30 of the first cylinder 85 abut against each other, and the first pusher 83 is restricted from moving toward the side opposite to the housing 30.

In the second rotating step S106, the second cylinder 92 of the second pusher 90 is extended so that the sprocket pressing portion 91 presses the gear 9 of the sprocket 20. As a result, the sprocket 20 rotates in the advance direction. By performing the second rotating step S106, the knock pin 60 is applied with the torque T1 outputted from the first cylinder 85 and the torque T2 outputted from the second cylinder 92. When the load outputted from the second cylinder 92 is F2 (N) and the distance between the rotation center of the sprocket 20 and the abutting position of the sprocket pressing portion 91 is L2 (m), the torque T2 (Nm) outputted from the second cylinder 92 is given by the following equation.

$$T2=F2\times L2 \quad \text{(Equation 2)}$$

The load F2 outputted from the second cylinder 92 is larger than the load F1 outputted from the first cylinder 85. For example, the load F1 is 50 N, and the load F2 is 120 N. However, there may be a case where the knock pin 60 and the inner wall of the sprocket hole 25 do not abut against each other, and the sprocket 20 does not rotate, if foreign matter is present between the lower aligning portion 74 of the lower jig 71 and the hole 21 of the sprocket 20. This case will be explained later.

Subsequently, a second measuring step S107 is performed to measure the load applied between the sprocket pressing portion 91 and the second cylinder 92 using the second load cell 93. The control section 94 checks whether or not the load measured by the second load cell 93 is equivalent to the load F2 outputted from the second cylinder 92. If the check result is affirmative, the method proceeds to a proofing step S108. On the other hand, if the check result is negative, the method is terminated assuming that a problem has occurred in the manufacturing apparatus 70 (step S120).

In the proofing step S108, the load applied between the housing pressing portion 84 and the first cylinder 85 is measured again using the first load cell 86. Here, the load applied from the second cylinder 92 to the housing pressing portion 84 through the sprocket 20, the knock pin 60 and the housing 30 is assumed to be $\alpha$. The control section 94 checks whether or not the load measured by the first load cell 86 is equivalent to the sum F3 of the load F1 outputted from the first cylinder 85 and the load $\alpha$. If the check result is affirmative, the method proceeds to a second clamping step S109. The load F3 (N) is given by the following equation.

$$F3=F1+\alpha=F1+F2\times L2/L1 \quad \text{(Equation 3)}$$

On the other hand, if the check result is negative, the method is terminated assuming that a problem has occurred in the manufacturing apparatus 70 (S120).

When the knock pin 60 abuts against the inner wall of the sprocket hole 25, the load F2 outputted from the second cylinder 92 is applied as the load $\alpha$ to the first load cell 86 from the inner wall of the housing hole 47 through the inner wall of the sprocket hole 25 and the knock pin 60. Accordingly, the load measured by the first load cell 86 is equivalent to the load F3. However, when the knock pin 60 does not abut against the inner wall of the sprocket hole 25, the load measured by the first load cell 86 is not equivalent to the load F3. Accordingly, by performing the proofing step S108, it is possible to ensure that the knock pin 60 and the inner wall of the sprocket hole 25 are in abutment with each other.

In the second clamping step S109, the pressing section 82 is driven to press the housing 30 and the sprocket 20 at a load under which the sprocket 20 and the housing 30 cannot rotate relative to each other. For example, this load is 1800 N. By performing the second clamping step S109, the housing 30 and the sprocket 20 can be prevented from deviating from each other in a subsequent coupling step S110. In the coupling step S110, a bolt 39 inserted from the bolt hole 38 of the housing 30 is screwed to the female thread 24 of the sprocket 20. This completes the assembly between the housing 30 and the sprocket 20 of the valve timing adjusting device 1.

The first embodiment provides the following advantages.

(1) The knock pin 60 abuts against the inner wall at the retard side of the sprocket hole 25 at its one end, and is pressure-inserted into the housing hole 47 at its other end. Accordingly, the housing 30 and the sprocket 20 can be prevented from deviating from each other due to the collision force between the inner wall of the housing 30 and the vane rotor 50 at the moment when the vane rotor 50 is phase-controlled to the most retarded position at an engine start. Accordingly, the valve timing adjusting device 1 can correctly perform the phase control between the crankshaft 3 and the camshaft 7 while preventing the bolt 39 fixing the sprocket 20 to the housing 30 from being loosened.

(2) The knock pin 60 is pressure-inserted into the housing hole 47 at its other end. This makes it possible to prevent the knock pin 60 from coming off when assembling the housing 30 and the sprocket 20, and to eliminate the clearance between the inner wall of the housing hole 47 and the knock pin 60.

(3) The sprocket hole 25 is a blind hole which is opened at the side of the housing 30 and is closed at the side opposite to the housing 30, and the housing hole 47 is a blind hole which is opened at the side of the sprocket 20 and is closed at the side opposite to the sprocket 20. This makes it possible to prevent the knock pin 60 from coming off from the sprocket hole 25 or the housing hole 47.

(4) The manufacturing apparatus 70 has the structure in which the lower jig 71 and the upper jig 77 rotatably support the sprocket 20 and the housing 30, the first pusher 83 rotates the housing 30 in the retard direction, and the second pusher 90 rotates the sprocket 20 in the advance direction. This makes it possible that the inner wall at the retard side of the sprocket hole 25 and the knock pin 60 abut against each other without a clearance therebetween. Hence, according to the manufacturing apparatus 70, it is possible to manufacture the valve timing adjusting device 1 capable of preventing a positional deviation between the housing 30 and the sprocket 20 due to collision between the inner wall of the housing 30 and the vane rotor 50.

(5) In the manufacturing apparatus 70, the first pusher 83 linearly presses the housing at a point distant from the rotation center of the housing 30, and the second pusher 90 linearly presses the sprocket 20 at a point distant from the rotation center of the sprocket 20. Accordingly, the housing 30 and the sprocket 20 can be rotated by the simple structure, and the load outputted from the first pusher 83 and the load outputted from the second pusher 90 can be correctly measured by the first load cell 86 and the second load cell 93, respectively.

(6) The manufacturing apparatus 70 includes the wedge member 88 insertable between the first pusher 83 and the fixing member 87. This makes it possible to prevent the first pusher 83 from moving toward the side opposite to the housing 30 by being pushed by the second pusher 90 at the time when the first pusher 83 rotates the housing 30 in the retard direction and then the second pusher 90 rotates the sprocket 20 in the advance direction.

(7) The manufacturing apparatus 70 includes the pressing section 82 capable of pressing the lower and upper jigs 71 and 77 at a load under which the sprocket 20 and the housing 30 cannot rotate relative to each other. This makes it possible to prevent the housing 30 and the sprocket 20 from deviating from each other at the time when the housing 30 and the sprocket 20 are fixed by the bolt 39.

(8) In the manufacturing method according to the first embodiment, after the first pusher 83 rotates the housing 30 in the retard direction and the second pusher 90 rotates the sprocket 20 in the advance direction, the sprocket 20 and the housing 30 are screwed to each other by the bolt 39. This makes it possible that the inner wall at the retard side of the sprocket hole 25 and the knock pin 60 abut against each other without a clearance therebetween.

(9) The manufacturing method according to the first embodiment includes the first measuring step S104 where the load applied to the first pusher 83 is measured after the first rotating step S103, and the proofing step S108 where the load applied to the first pusher 83 is measured after the second rotating step S106. Accordingly, it is possible to ensure that the knock pin 60 and the inner wall at the retard side of the sprocket hole 25 are in abutment with each other without a clearance therebetween, if the load F3 measured in the proofing step S108 is detected to be larger than the load F1 measured in the first measuring step S104.

(10) The manufacturing method according to the first embodiment includes the second measuring step S107 for measuring the load applied to the second pusher 90 which is performed after the second rotating step S106 and before the proofing step S108. Accordingly, the load F3 applied to the first pusher 83 can be confirmed in the proofing step S108 after the load F2 is confirmed in the second measuring step S107.

Second Embodiment

Figure 9:
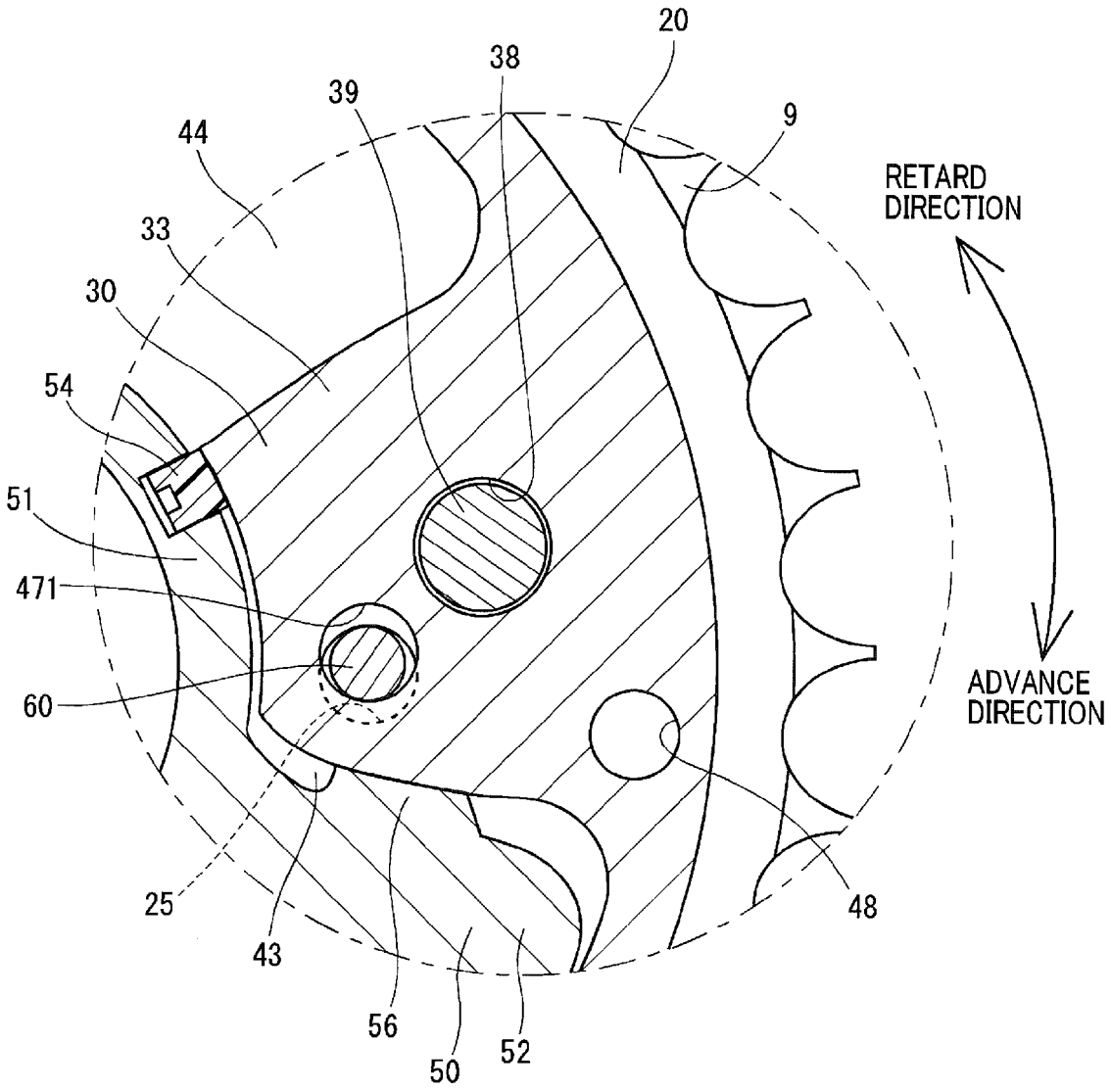
FIG. 9 is a cross-sectional view of main parts of a valve timing adjusting device according to a second embodiment of the invention.

Next, a second embodiment of the invention is described with reference to FIG. 9. In the following, the components of the second embodiment which are the same as or equivalent to the components of the first embodiment are indicated by the same reference numerals. In the second embodiment, the inner diameter of a housing hole 471 is slightly larger than the outer diameter of the knock pin 60. In FIG. 9, to ease explanation, the inner diameter of the housing hole 471 and the inner diameter of the sprocket hole 25 are shown larger than their actual sizes. The knock pin 60 abuts against the inner wall at the retard side of the sprocket hole 25 at its one end, and abuts against the inner wall at the advance side of the housing hole 471 at its other end. According to also the second embodiment, the knock pin 60 prevents deviation between the housing 30 and the sprocket 20.

Other Embodiments (1) The above embodiments relates to a valve timing adjusting device for adjusting open/close timing of an intake valve. However, it goes without saying that the present invention can be used for a valve timing adjusting device for adjusting open/close timing of an exhaust valve. Generally, a common valve timing adjusting device for an exhaust valve of an engine is provided with a spring or the like for biasing its vane rotor toward the advance side, and accordingly, the vane rotor is located on the advance side while the engine is stopped. The present invention has advantages in a case where the biasing force of the spring becomes insufficient, and the vane rotor is stopped at an intermediate-phase position.

(2) In the above embodiments, the knock pin is inserted into the housing hole at its other end. However, the knock pin may be inserted into the housing hole at its one end.

The above explained preferred embodiments are exemplary of the invention of the present application which is described solely by the claims appended below. It should be understood that modifications of the preferred embodiments may be made as would occur to one of skill in the art.

What is claimed is:

1. A manufacturing apparatus for manufacturing a valve timing adjusting device that adjusts an open/close timing of an intake valve or an exhaust valve driven by a driven shaft of an engine by varying a rotational phase between the driven shaft and a driving shaft of the engine, wherein the valve timing adjusting device comprises:

a sprocket configured to rotate by receiving drive power from the driving shaft;

a vane rotor fixed to the driven shaft so as to be rotatable relative to the sprocket;

a housing that includes an oil chamber housing the vane rotor, the housing being fixed to one end in a thickness direction of the sprocket;

a bolt fixing the sprocket to the housing; and a knock pin inserted into a sprocket hole formed in the sprocket at one end thereof and into a housing hole formed in the housing at the other end thereof to restrict relative relation between the sprocket and the housing; wherein when a direction to which the vane rotor is phase-controlled when starting the engine is referred to as a first direction, and a direction opposite to the first direction is referred to as a second direction, the knock pin abuts against an inner wall in the first direction of the sprocket hole at one end thereof, and abuts against an inner wall in the second direction of the housing hole at the other end thereof; and the manufacturing apparatus comprises:

a lower jig that rotatably supports the sprocket in a state where one end of the knock pin is inserted into the sprocket hole of the sprocket;

an upper jig that rotatably supports the housing in a state where the other end of the knock pin is inserted into the housing hole of the housing;

a first pusher that rotates the housing to the first direction to which the vane rotor is rotated relative to the housing at the time of starting the engine; and a second pusher that rotates the sprocket to the second direction opposite to the first direction.

2. The manufacturing apparatus according to claim 1, wherein the first pusher is configured to linearly press the housing at a point distant from a rotation center of the housing, and the second pusher is configured to linearly press the sprocket at a point distant from a rotation center of the sprocket.

3. The manufacturing apparatus according to claim 2, further comprising a fixing member disposed at a side opposite to the housing of the first pusher and a wedge member insertable between the fixing member and the first pusher.

4. The manufacturing apparatus according to claim 1, further comprising a pressing section for pressing the lower jig and the upper jig in a mutually approaching direction at a load under which the housing and the sprocket cannot rotate relative to each other.

5. The manufacturing apparatus according to claim 1, further comprising a first measuring section for measuring a first load applied to the first pusher at the time of rotating the housing, a second measuring section for measuring a second load applied to the second pusher at the time of rotating the sprocket, and a control section that detects whether a value of the first load which the first measuring section measures after the sprocket is rotated by the second pushers is larger than the a value of the first load which the first measuring section measures before the sprocket is rotated by the second pusher.

6. A manufacturing method of manufacturing a valve timing adjusting device for adjusting open/close timing of an intake valve or an exhaust valve driven by a driven shaft of an engine by varying a rotational phase between the driven shaft and a driving shaft of the engine, the valve timing adjusting device comprising:

a sprocket configured to rotate by receiving drive power from the driving shaft;

a vane rotor fixed to the driven shaft so as to be rotatable relative to the sprocket;

a housing that includes an oil chamber housing the vane rotor, the housing being fixed to one end in a thickness direction of the sprocket;

a bolt fixing the sprocket to the housing; and a knock in inserted into a s rocket hole formed in the s rocket at one end thereof and into a housing hole formed in the housing at the other end thereof to restrict relative relation between the sprocket and the housing:

wherein, when a direction to which the vane rotor is phase-controlled when starting the engine is referred to as a first direction, and a direction opposite to the first direction is referred to as a second direction, the knock pin abuts against an inner wall in the first direction of the sprocket hole at one end thereof, and abuts against an inner wall in the second direction of the housing hole at the other end thereof, using the manufacturing apparatus recited in claim 1, comprising:

a preparation step of housing the vane rotor between the housing and the sprocket, inserting one end of the knock pin into the sprocket hole and inserting the other end of the knock pion into the housing hole;

a first clamping step of pressing the housing and the sprocket toward each other at a load under which the sprocket placed on the lower jig and the housing placed on the upper jig can rotate relative to each other;

a first rotating step of rotating the housing to the first direction to which the vane rotor is rotated relative to the housing at the time of starting the engine;

a second rotating step of rotating the sprocket to the second direction opposite to the first direction;

a second clamping step of pressing the lower jig and the upper jig toward each other at a load under which the housing and the sprocket cannot rotate relative to each other; and a coupling step of coupling the sprocket and the housing to each other by the bolt.

7. The manufacturing method according to claim 6, further comprising a first measuring step of measuring a load applied to the first pusher performed after the first rotating step and a proofing step of measuring a load applied to the first pusher performed after the second rotating step.

8. The manufacturing method according to claim 7, further comprising a second rotating step of measuring a load applied to the second pusher performed after the second rotating step and before the proofing step.

* * * * *